US007068225B2

(12) United States Patent
Schantz

(10) Patent No.: US 7,068,225 B2
(45) Date of Patent: Jun. 27, 2006

(54) NANO-ANTENNA APPARATUS AND METHOD

(75) Inventor: Hans Gregory Schantz, Huntsville, AL (US)

(73) Assignee: Next-RF, Inc., Huntsville, AL (US)

( * ) Notice: Subject to any disclaimer, the term of this patent is extended or adjusted under 35 U.S.C. 154(b) by 41 days.

(21) Appl. No.: 11/010,083

(22) Filed: Dec. 11, 2004

(65) Prior Publication Data

US 2005/0128146 A1 Jun. 16, 2005

Related U.S. Application Data

(60) Provisional application No. 60/529,064, filed on Dec. 12, 2003.

(51) Int. Cl.
*H01Q 1/38* (2006.01)

(52) U.S. Cl. ..... 343/700 MS; 343/701; 600/309

(58) Field of Classification Search ..... 343/700 MS, 343/701; 600/309
See application file for complete search history.

(56) References Cited

U.S. PATENT DOCUMENTS 5,382,788 A * 1/1995 Kim et al. ..... 250/214.1
5,444,308 A * 8/1995 O'Loughlin ..... 307/106
5,656,873 A * 8/1997 O'Loughlin et al. ..... 307/106

* cited by examiner

*Primary Examiner*—Hoang V. Nguyen
*Assistant Examiner*—Chuc Tran

(57) ABSTRACT

A nano-antenna apparatus (or equivalently a nano-antenna device) comprises a first conducting surface, a second conducting surface, a gap region between a first conducting surface and a second conducting surface and at least one discharge switch at least one discharge switch cooperates with first conducting surface, a second conducting surface to form a substantially continuous closed surface enclosing a volume. This volume may be substantially similar to a spheroid, a prolate spheroid, an oblate spheroid, a Cartesian rectangular solid or other shape. This volume may enclose at least one electric device. A dimension of the volume and a dielectric constant characterizing a dielectric layer may be chosen so as to yield a desired frequency response. Further, this volume may partition outside energy from inside energy, causing the former energy to radiate away.

This invention further teaches a method for transmitting UWB impulse. This method comprises the steps of charging a first conducting surface with respect to a second conducting surface, and discharging a first conducting surface with respect to a second conducting surface such that the discharging forms a substantially continuous closed conducting shell from a first conducting surface and a second conducting surface. In alternate embodiments the discharging or charging may be adiabatic. Discharging may be positioned in time in accordance with a pulse position modulation scheme. Charging may be polarized in accordance to a flip or BPSK modulation scheme. Discharging may be effected by diodes, transistors, or MEMS devices.

20 Claims, 4 Drawing Sheets

300

400

500

600

700

NANO-ANTENNA APPARATUS AND METHOD

This application claims benefit of prior filed co-pending Provisional Patent Application Ser. No. 60/529,064 filed Dec. 12, 2003 which is incorporated herein by reference.

BACKGROUND OF THE INVENTION

1. Field of the Invention

The present invention relates to antennas and more specifically to a system and method to utilize a conducting enclosure as a highly efficient electrically small antenna.

2. Description of the Prior Art

Ultra-wideband (UWB) systems are in great demand for precision tracking, radar, and communications. A commercially successful UWB system must be both small and very low power. Similarly, there is great interest at present in "smart dust," miniature sensors, and other nano-devices that can wirelessly transmit data, positioning signals, or radar signals using very low power signals and utilizing wavelengths that may be much larger than the device itself. Highly efficient, electrically small antennas are a necessity for UWB systems, smart dust, nano-devices, and numerous other commercial and government applications.

Prior art efficient antennas commonly are on the order of a half-wavelength long for a dipole or a quarter-wavelength long for a monopole. For ultra-wideband (UWB) operation in the 3.1–10.6 GHz, a 5.3 cm dipole or a 2.6 cm monopole are called for (5.7 GHz center frequency). These antennas may be small enough for some applications. For other applications, even smaller antennas may be required. Efficient quarter to half wave antennas that operate in the upper VHF band or UHF band (for instance from 100 MHz on up) must be significantly larger than analogous microwave antennas. This is too large for many potential applications. In general however, no matter the application, there is always a need to make antennas smaller and less obtrusive while remaining efficient. Existing small VHF/UHF UWB antennas tend to be very inefficient including large current radiators, and resistively loaded antennas. Antennas smaller than a quarter-wavelength are usually referred to as electrically small antennas. In prior art, electrically small antennas are prone to be inefficient, particularly when significantly smaller than a quarter-wavelength.

In view of the foregoing, there is a great need for an efficient, electrically small UWB antenna for positioning, smart dust, nano-devices, and other applications. There is a further need for a method to effect efficient UWB transmissions from electrically small enclosures. Additionally, there is a need for an antenna apparatus that transcends traditionally accepted bounds of antenna size versus performance.

SUMMARY OF THE INVENTION

Accordingly, it is an object of the present invention to provide an efficient, electrically small ultra-wideband (UWB) antenna apparatus for positioning, smart dust, nano-devices, and other applications. It is a further object of the present invention to provide a method to effect efficient UWB transmissions from electrically small enclosures. Yet another object of the present invention is to implement an antenna apparatus that transcends traditionally accepted bounds of antenna size versus performance. These objects and more are met by the present invention: a "nano-antenna" apparatus and method.

A nano-antenna apparatus (or equivalently a nano-antenna device) comprises a first conducting surface, a second conducting surface, a gap region between a first conducting surface and a second conducting surface and at least one discharge switch. In preferred embodiments, at least one discharge switch substantially isolates a gap region. A discharge switch may operate at a time according to a pulse modulation scheme. Further, a nano-antenna device may include charging means capable of polarizing a nano-antenna device according to a flip or BPSK modulation scheme. A nano-antenna device may also include a dielectric layer and a first and second conducting surface may be substantially symmetric or substantially asymmetric.

In some embodiments, at least one discharge switch cooperates with first conducting surface, a second conducting surface to form a substantially continuous closed surface enclosing a volume. This volume may be substantially similar to a spheroid, a prolate spheroid, an oblate spheroid, a Cartesian rectangular solid or other shape. This volume may enclose at least one electric device. A dimension of the volume and a dielectric constant characterizing a dielectric layer may be chosen so as to yield a desired frequency response. Further, this volume may partition outside energy from inside energy, causing the former energy to radiate away.

This invention further teaches a method for transmitting UWB impulse. This method comprises the steps of charging a first conducting surface with respect to a second conducting surface, and discharging a first conducting surface with respect to a second conducting surface such that the discharging forms a substantially continuous closed conducting shell from a first conducting surface and a second conducting surface. In alternate embodiments the discharging or charging may be adiabatic. Discharging may be positioned in time in accordance with a pulse position modulation scheme. Charging may be polarized in accordance to a flip or BPSK modulation scheme. Discharging may be effected by diodes, transistors, or MEMS devices.

With these and other objects, advantages, and features of the invention that may become hereinafter apparent, the nature of the invention may be more clearly understood by reference to the detailed description of the invention, the appended claims and to the several drawings herein.

DETAILED DESCRIPTION OF THE PREFERRED EMBODIMENT

Overview of the Invention

The present invention is directed to a nano-antenna apparatus and method. Instead of an antenna apparatus distinct from an associated RF device as taught in the prior art, the present invention teaches that an enclosure surrounding an RF device be used as an antenna. This conducting enclosure antenna makes best possible use of the available form factor for an RF device. Thus, a conducting enclosure antenna provides performance superior to a smaller antenna that is a mere adjunct to the device. A conducting enclosure antenna is also a "nano-antenna," an antenna that potentially transcends traditionally accepted limits to antenna size and performance by offering the performance and efficiency of a typical quarter-wave antenna in a package that may 1% of a wavelength in dimension or even smaller.

The present invention will now be described more fully in detail with reference to the accompanying drawings, in which the preferred embodiments of the invention are shown. This invention should not, however, be construed as limited to the embodiments set forth herein; rather, they are provided so that this application will be thorough and complete and will fully convey the scope of the invention to those skilled in the art. Like numbers refer to like elements throughout.

PREFFERRED EMBODIMENT

Figure 1:
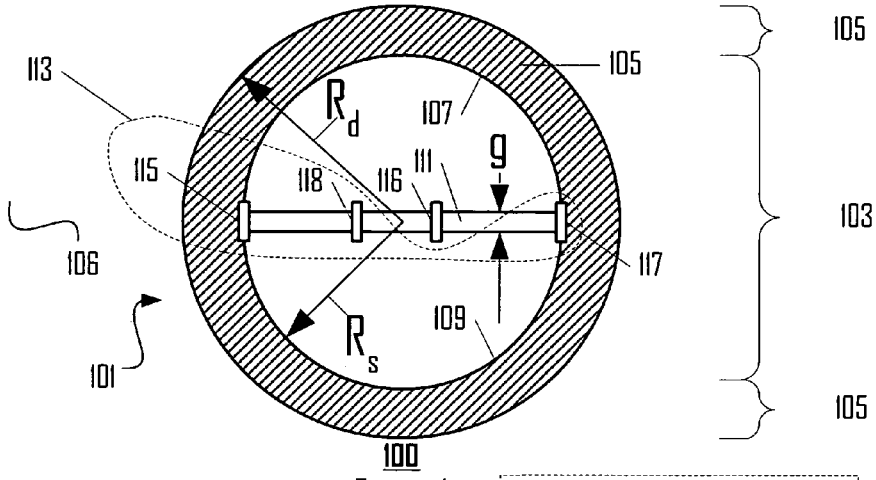
FIG. 1 is a cross-section of a preferred embodiment nano-antenna apparatus.

FIG. 1 is a cross-section 100 of a preferred embodiment nano-antenna device 101. Preferred embodiment nano-antenna device 101 comprises conducting enclosure antenna 103, and dielectric layer 105. For ease of theoretical calculation, conducting enclosure antenna 103, is assumed to be spherical with radius $R_S$, and dielectric layer 105 is assumed to have a thickness $R_d$–$R_S$. Thus, nano-antenna device 101 has a total radius Rd. In practice, nano-antenna device 101 may assume a wide variety of form factors suitable for particular applications. Some of these form factors will be discussed later as particular alternate embodiments. Dielectric layer 105 also acts so as to electrically insulate conducting enclosure antenna 103 from electrical contact with surrounding space 106. Surrounding space 106 may include not only free space, but also ground, human bodies, and any other objects in the immediate vicinity of nano-antenna device 101. In practice, since most of the electrostatic energy is concentrated around the gap, it may be preferred for dielectric layer 105 to be thicker in the vicinity of the gap or have another non-uniform thickness profile. Similarly, dielectric layer 105 need not be characterized by a fixed dielectric constant, but rather may have a dielectric constant that varies according to a desired impedance taper.

Conducting enclosure antenna 103 further comprises a first conducting surface 107, a second conducting surface 109, and discharge switching means 113. First conducting surface 107, and second conducting surface 109 are separated by a gap region 111 with gap width g. Discharge switching means 113 further comprises first boundary discharge switch 115 and second boundary discharge switch 117. First boundary discharge switch 115 and second boundary discharge switch 117 are preferentially high efficiency switches capable of switching speeds substantially faster than a characteristic time associated with a radiated signal from nano-antenna device 101. First boundary discharge switch 115 and second boundary discharge switch 117 may be step recovery or other diodes, FET or other high speed transistors, MEMS devices, or other high speed, high efficiency switching devices. In alternate embodiments, discharge switching means 113 may further comprise filtering means to enable nano-antenna device 101 to radiate signals within a desired spectral mask. In a preferred embodiment, first boundary discharge switch 115 and second boundary discharge switch 117 act so as to electrically isolate gap region 111 from dielectric layer 105 and surrounding space 106. In optional embodiments, discharge switching means 113 may further comprise internal discharge switch 118.

In a preferred mode of operation, conducting enclosure antenna 103 begins in a charged state with first conducting surface 107 charged to a particular voltage with respect to second conducting surface 109. Conversely (and equivalently), one may think of second conducting surface 109 charged to a particular voltage with respect to first conducting surface 107. Charging switch 116 is useful in this charging process as will be explained further in reference to effective electrical circuit diagram 200. Gap region 111, dielectric layer 105, and surrounding space 106 store electrostatic energy $U_{tot}=U_{in}+U_{out}$ associated with the original charged state of first conducting surface 107 with respect to second conducting surface 109. Discharge switching means 113 then acts so as to discharge first conducting surface 107 and second conducting surface 109. Simultaneously, discharge switching means 113 acts so as to electrically isolate gap region 111 from dielectric layer 105 and surrounding space 106. Thus in a preferred mode of operation, discharge switching means 113 partitions outside electrostatic energy $U_{out}$ from inside electrostatic energy $U_{in}$. Discharge switching means 113 thus causes outside electrostatic energy $U_{out}$ stored in dielectric layer 105 and surrounding space 106 to be isolated, to decouple, and to radiate away as a UWB impulse. Discharge switching means 113 causes inside electrostatic energy $U_{in}$ stored in gap region 111 to be absorbed or dissipated.

In a preferred mode of operation, nano-antenna device 101 becomes a radiator of electromagnetic ultra-wideband impulses associated with the decoupling of outside electrostatic energy $U_{out}$ originally stored in dielectric layer 105 and surrounding space 106. The efficiency of nano-antenna device 101 is a function of the fraction of energy originally stored in dielectric layer 105 and surrounding space 106 to the total electrostatic energy.

One may improve efficiency of nano-antenna device 101 by minimizing electrostatic energy $U_{in}$ stored in gap region 111. Electrostatic energy $U_{in}$ stored in gap region 111 may be minimized by filling gap region 111 with a relatively low dielectric constant medium such as free space or air. Electrostatic energy $U_{in}$ stored in gap region 111 may further be minimized by controlling the geometry of gap region 111. For instance one might maximize gap with g subject to other design constraints.

Alternatively, one may improve efficiency of nano-antenna device 101 by maximizing electrostatic energy $U_{out}$ stored in dielectric layer 105 and surrounding space 106. Electrostatic energy $U_{out}$ stored in dielectric layer 105 and surrounding space 106 may be maximized employing a relatively high dielectric constant medium in dielectric layer 105. Electrostatic energy $U_{out}$ stored in dielectric layer 105 and surrounding space 106 may further be maximized by controlling the geometry of first conducting surface 107 and second conducting surface 109.

In summary, by minimizing electrostatic energy stored in gap region 111 $U_{in}$ and/or by maximizing electrostatic energy $U_{out}$ stored in dielectric layer 105 and surrounding space 106 efficiency of nano-antenna device 101 can be made very high, even though nano-antenna device 101 may be electrically quite small. These and other details of the present invention will become clear upon understanding an effective electrical circuit and a process flow diagram.

Effective Electrical Circuit

Figure 2:
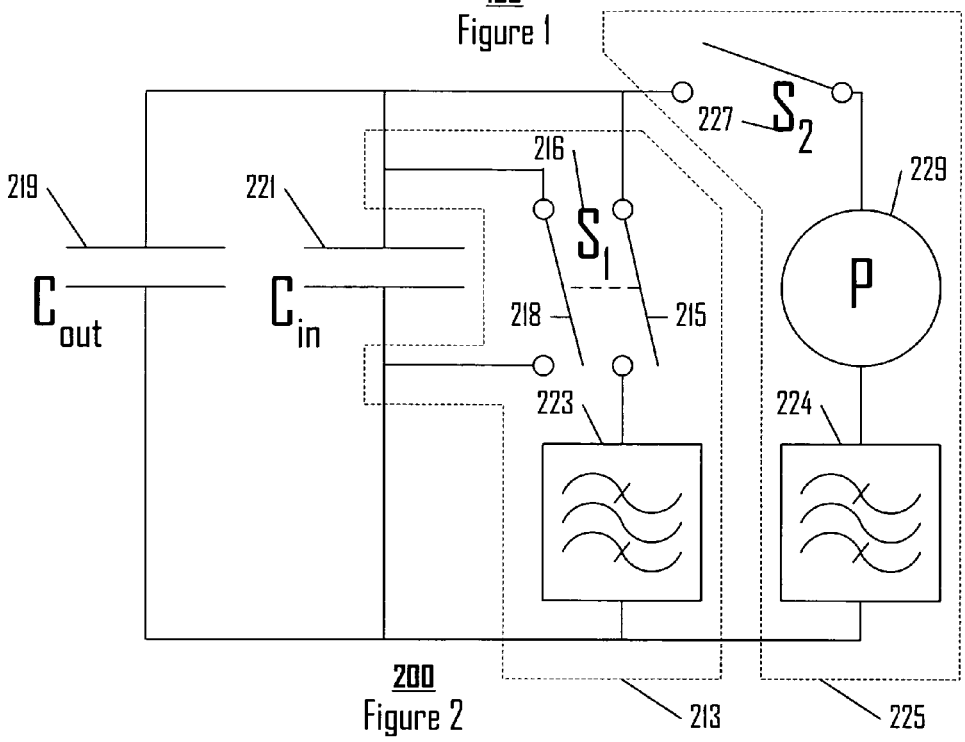
FIG. 2 is an effective electrical circuit diagram for a nano-antenna apparatus.

FIG. 2 is an effective electrical circuit diagram 200 for nano-antenna apparatus 101. First conducting surface 107, second conducting surface 109, dielectric layer 105, and surrounding space 106 cooperate to form outer capacitance $C_{out}$ 219. First conducting surface 107, second conducting surface 109, and gap region 111 cooperate to form inner capacitance $C_{in}$ 221. Discharge switching means 213 comprises discharge switch $S_1$ 216.

Discharge switch $S_1$ 216 comprises boundary discharge switch 215. Boundary discharge switch 215 in effective electrical circuit diagram 200 represents a plurality of actual switches such as first boundary discharge switch 115 and second boundary discharge switch 117. In optional embodiments, discharge switch $S_1$ 216 may be a double pole single throw switch further comprising internal discharge switch 218. Internal discharge switch 218 acts so as to short out inner capacitance $C_{in}$ 221. Here again, internal discharge switch 218 in effective electrical circuit diagram 200 represents a plurality of actual switches such as internal discharge switch 118. To reiterate, although boundary discharge switch 215 is shown as a single individual boundary discharge switch 215 in effective electrical circuit diagram 200, boundary discharge switch 215 represents the functionality of potentially many actual switches distributed around the periphery of gap region 111.

Discharge switching means 213 may also include filtering means 223. Filtering means 223 may be designed so as to ensure that nano-antenna device 101 radiates signals with spectral content within a desired spectral mask. If radiation from nano-antenna device 101 is not subject to a spectral mask, then filtering means 223 may not be required. Filtering means 223 is preferentially a diplexing filter in which out of band components are dissipated instead of reflected.

In alternate embodiments, discharge switching means 213 may be intended to discharge the parallel combination of outer capacitance $C_{out}$ 219 and inner capacitance $C_{in}$ 221 so slowly as to radiate no appreciable energy (i.e. adiabatically). Also under these circumstances, discharge switching means 213 may not require filtering means 223.

In a preferred embodiment, discharge switching means 213 acts so as to electrically isolate outer capacitance $C_{out}$ 219 from inner capacitance $C_{in}$ 221. Energy stored in inner capacitance $C_{in}$ 221 will be dissipated, for instance in internal discharge switch 218. Discharge switching means 213 accomplishes this goal by transforming first conducting surface 107 and second conducting surface 109 into a continuous closed conducting surface that electrically isolates outer capacitance $C_{out}$ 219 from inner capacitance $C_{in}$ 221. Similarly discharge switching means 213 acts to isolate boundary discharge switch 215 from internal discharge switch 218 so that internal discharge switch 218 discharges only inner capacitance $C_{in}$ 221.

Nano-antenna apparatus 101 also includes additional functionality not shown in FIG. 1. Nano-antenna apparatus 101 further comprises charging means 225. Charging means 225 includes charging switch $S_2$ 227 and power source 229. Charging switch $S_2$ 227 may be implemented with step recovery or other diodes, FET or other high speed transistors, MEMS devices, or other switching devices. Power source 229 may further comprise a voltage source, battery, current source, charge pump, or other source of electric energy. Power source 229 also preferentially includes means for operation with alternate polarity so that nano-antenna device 101 can radiate flipped or BPSK signals.

In a preferred mode of operation, charging means 225 is intended to charge the parallel combination of outer capacitance $C_{out}$ 219 and inner capacitance $C_{in}$ 221 so slowly (adiabatically) as to radiate no appreciable energy. If charging means 225 is intended to charge the parallel combination of outer capacitance $C_{out}$ 219 and inner capacitance $C_{in}$ 221 so quickly as to radiate appreciable energy, then charging means 225 may further include filtering means 224 so as to ensure that nano-antenna device 101 radiates signals within a desired spectral mask.

Method of Operation

Figure 3:
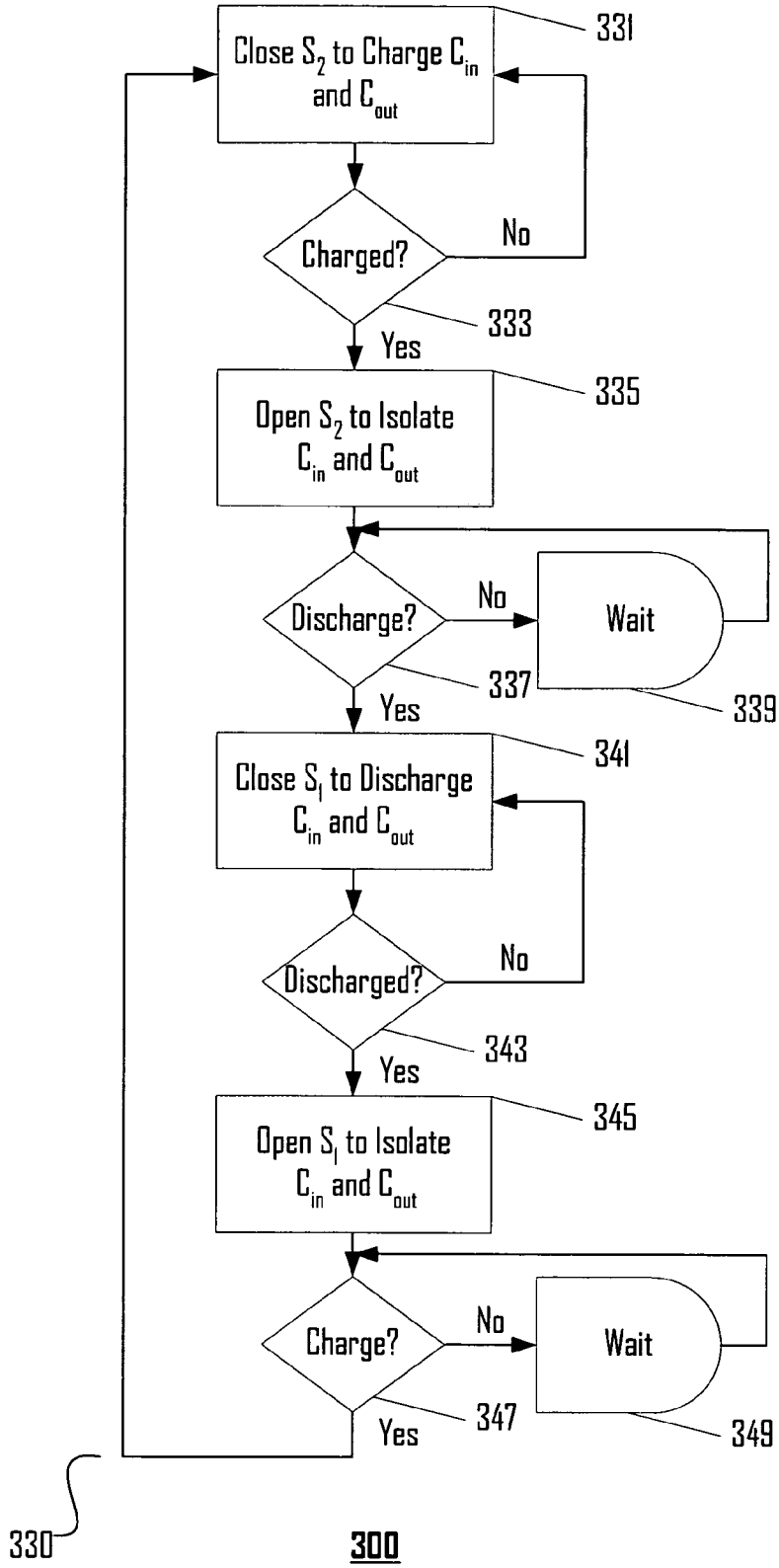
FIG. 3 is a flow chart describing a nano-antenna method of operation.

FIG. 3 is a flow chart 300 describing a method of operation 330 for transmitting UWB impulses. Method of operation 330 is a recursive operation that may repeat for as many cycles as are required to complete a desired transmission. nano-antenna method of operation 330 begins with process block 331 in which charging switch $S_2$ 227 closes to enable charging means 225 to charge the parallel combination of outer capacitance $C_{out}$ 219 and inner capacitance $C_{in}$ 221. In a preferred embodiment, process block 331 comprises a charging process in which charging takes place so slowly that substantially no radiation occurs (i.e. adiabatically). In alternate embodiments, process block 331 may comprise a charging process in which charging takes place so quickly that an impulse of radiation does occur. In further alternate embodiments, process block 331 may comprise a charging process with switchable polarity, thus enabling nano-antenna apparatus 101 to radiate signals with "flip" or BPSK modulation.

Method of operation 330 continues with decision block 333. Decision block 333 assesses whether the parallel combination of outer capacitance $C_{out}$ 219 and inner capacitance $C_{in}$ 221 is adequately charged. If "No," then method of operation 330 continues back at process block 331. If "Yes," then method of operation 330 continues at process block 335 in which charging switch $S_2$ 227 opens to isolate the parallel combination of outer capacitance $C_{out}$ 219 and inner capacitance $C_{in}$ 221.

Method of operation 330 continues with decision block 337. Decision block 337 assesses whether the time has arrived to discharge the parallel combination of outer capacitance $C_{out}$ 219 and inner capacitance $C_{in}$ 221. Decision block 337 (and potentially optional delay block 339) may act in accordance with a desired pulse position modulation scheme so as to cause a discharge and associated radiated energy to occur at a desired time. If "No," then method of operation 330 continues with optional delay block 339 before continuing back at decision block 337. If "Yes," then method of operation 330 continues at process block 341 in which discharge switch $S_1$ 216 closes to discharge the parallel combination of outer capacitance $C_{out}$ 219 and inner capacitance $C_{in}$ 221. In a preferred embodiment, process block 341 comprises a discharging process in which discharging takes place so quickly that an impulse of radiation does occur. In alternate embodiments, process block 341 comprises a discharging process in which discharging takes place so slowly that substantially no radiation occurs (i.e. adiabatically). For proper function as a radiating device, at least one of process block 331 and process block 341 must not be adiabatic in order for radiation to occur. In yet other alternate embodiments, process block 331 and process block 341 may vary between rapid and adiabatic charging and/or discharging, respectively, in accordance with a particular modulation scheme.

Method of operation 330 continues with decision block 343. Decision block 343 assesses whether the discharge of the parallel combination of outer capacitance $C_{out}$ 219 and inner capacitance $C_{in}$ 221 is complete. If "No," then method of operation 330 continues back at process block 341. If "Yes," then method of operation 330 continues at process block 345 in which discharge switch $S_1$ 216 opens to isolate the parallel combination of outer capacitance $C_{out}$ 219 and inner capacitance $C_{in}$ 221.

Method of operation 330 continues with decision block 347. Decision block 347 assesses whether the time has arrived to charge the parallel combination of outer capacitance $C_{out}$ 219 and inner capacitance $C_{in}$ 221. If "No," then method of operation 330 continues with optional delay block 349 before continuing back at decision block 347. If "Yes," then method of operation 330 continues back at process block 331.

Theory of Operation and Design Examples

In a preferred embodiment, nano-antenna apparatus 101 acts so as to isolate or partitions outside electrostatic energy ($U_{out}=\frac{1}{2}C_{out}V^2$) from inside electrostatic energy ($U_{in}=\frac{1}{2}C_{in}V^2$). Conducting enclosure antenna 103 forms a substantially continuous closed conducting surface that substantially partitions total energy into outside electrostatic energy $U_{out}$ and inside electrostatic energy $U_{in}$. Outside electrostatic energy $U_{out}$ then decouples and radiates away as a UWB impulse with a time dependence and frequency content dependent upon dimensional factors (like $R_S$ and $R_d$) as well as properties of dielectric layer 105. Since the same voltage difference V applies to both capacitances, outside electrostatic energy $U_{out}$ and inside electrostatic energy $U_{in}$. are directly proportional to outer capacitance $C_{out}$ 219 and inner capacitance $C_{in}$ 221, respectively. Thus, the efficiency η of nano-antenna apparatus 101 is:

$$\eta = \frac{U_{out}}{U_{tot}} = \frac{U_{out}}{U_{in}+U_{out}} = \frac{C_{out}}{C_{in}+C_{out}} \tag{1}$$

The severe dielectric interface may be prone to reflect signals and disperse the signals. Assuming dielectric losses and ohmic losses in conducting enclosure antenna 103, in dielectric layer 105, and discharge switching means 113 are negligible, the only other loss mechanism is radiation. A further consideration is that the boundary between dielectric layer 105 and surrounding space 106 lies within the near field zone, and thus energy is likely to "tunnel" through the boundary. In any event, a nano-antenna device 101 will radiate quite efficiently.

UHF Design Example

Consider spherical nano-antenna device 101 with a radius $R_S$=10 cm and no dielectric. Spherical nano-antenna device 101 will then exhibit dipole like behavior with half power points around 200 MHz and 1000 MHz. A 20 cm diameter spherical nano-antenna device 101 may be too large for many applications. Consider instead a spherical nano-antenna device 101 with a radius $R_S$=1 cm. By simple scaling relations, this dimensionally ten times smaller spherical nano-antenna device 101 will have a frequency response ten times higher: 2000 MHz to 10,000 MHz. Suppose this spherical nano-antenna device 101 with a radius $R_S$=1 cm is embedded in dielectric layer 105 composed of a high dielectric constant material (such as $TiO_2$ with relative dielectric constant $\epsilon_r$=100). Dielectric layer 105 may be thus characterized by a relative dielectric constant $\epsilon_r$. Since electrical size scales as $\sqrt{\epsilon_r}$, this spherical nano-antenna device 101 with a radius $R_S$=1 cm will now have the same frequency response as a spherical nano-antenna device 101 with a radius $R_S$=10 cm (i.e. 200 MHz to 1000 MHz). A dielectric layer 105 with thickness $R_S$–$R_d$ equal to radius $R_S$ is sufficient to encompass a region in which about 90% of outside electrostatic energy $U_{out}$ would be stored assuming there were no dielectric (other than free space). The exterior capacitance 219 will be about $C_{out}$=15 pF and the interior capacitance 221 will be about $C_{in}$=2 pF assuming a 60 mil gap. Thus a spherical nano-antenna device 101 with a conducting enclosure radius $R_S$=1 cm and a dielectric radius $R_d$=2 cm operating between 200–1000 MHz may be about the size of a golf ball with a diameter of 4 cm (a bit over 1.5 in). This nano-antenna device 101 will have an efficiency of:

$$\eta = \frac{C_{out}}{C_{in}+C_{out}} = \frac{15\,\text{pF}}{2\,\text{pF}+15\,\text{pF}} = 88\,\% \tag{2}$$

This efficiency is extraordinarily good for an antenna of electric radius 0.0133λ(i.e. 2 cm radius antenna operational at 200 MHz or λ=1.5 m).

Microwave Design Example

For a microwave frequency range design example, the frequency response of the previous section may be scaled up by a factor of ten so that the operational frequency lies between 2–10 GHz. As noted in the previous section, a nano-antenna device 101 with $R_{S=1}$ cm has the correct frequency response, however the outside capacitance 219 will be about $C_{out}$=0.15 pF and the interior capacitance 221 will be about $C_{in}$=2 pF assuming a 60 mil gap. The efficiency will be:

$$\eta = \frac{C_{out}}{C_{in}+C_{out}} = \frac{0.15\,\text{pF}}{2\,\text{pF}+0.15\,\text{pF}} = 6.98\,\% \tag{3}$$

Ironically, an even smaller dielectrically loaded nano-antenna apparatus 101 will be more efficient.

Consider a nano-antenna device 101 with $R_s$=1 mm embedded in dielectric layer 105 composed of a high dielectric constant material (such as $TiO_2$ with relative dielectric constant $\epsilon_r$=100) out to a radius $R_d$=2 mm. Then the frequency response is as desired (2–10 GHz), the exterior capacitance 219 will be about $C_{out}$=1.5 pF and the interior capacitance 221 will be about $C_{in}$=0.2 pF assuming a 5 mil gap. As before:

$$\eta = \frac{C_{out}}{C_{in}+C_{out}} = \frac{1.5\,\text{pF}}{0.2\,\text{pF}+1.5\,\text{pF}} = 88\,\% \tag{4}$$

With such dimensions, one could encapsulate a chip and make an ultra miniature UWB transmitter limited only by the constraints of the battery or power scavenging means.

These two examples illustrate how proper choice of a dimension of a nano-antenna device volume (such as $R_S$ and $R_d$) and proper choice of a dielectric constant characterizing a dielectric layer result in a desired frequency response.

DETAILED DESCRIPTION OF PREFERRED EMBODIMENT

Figure 4:
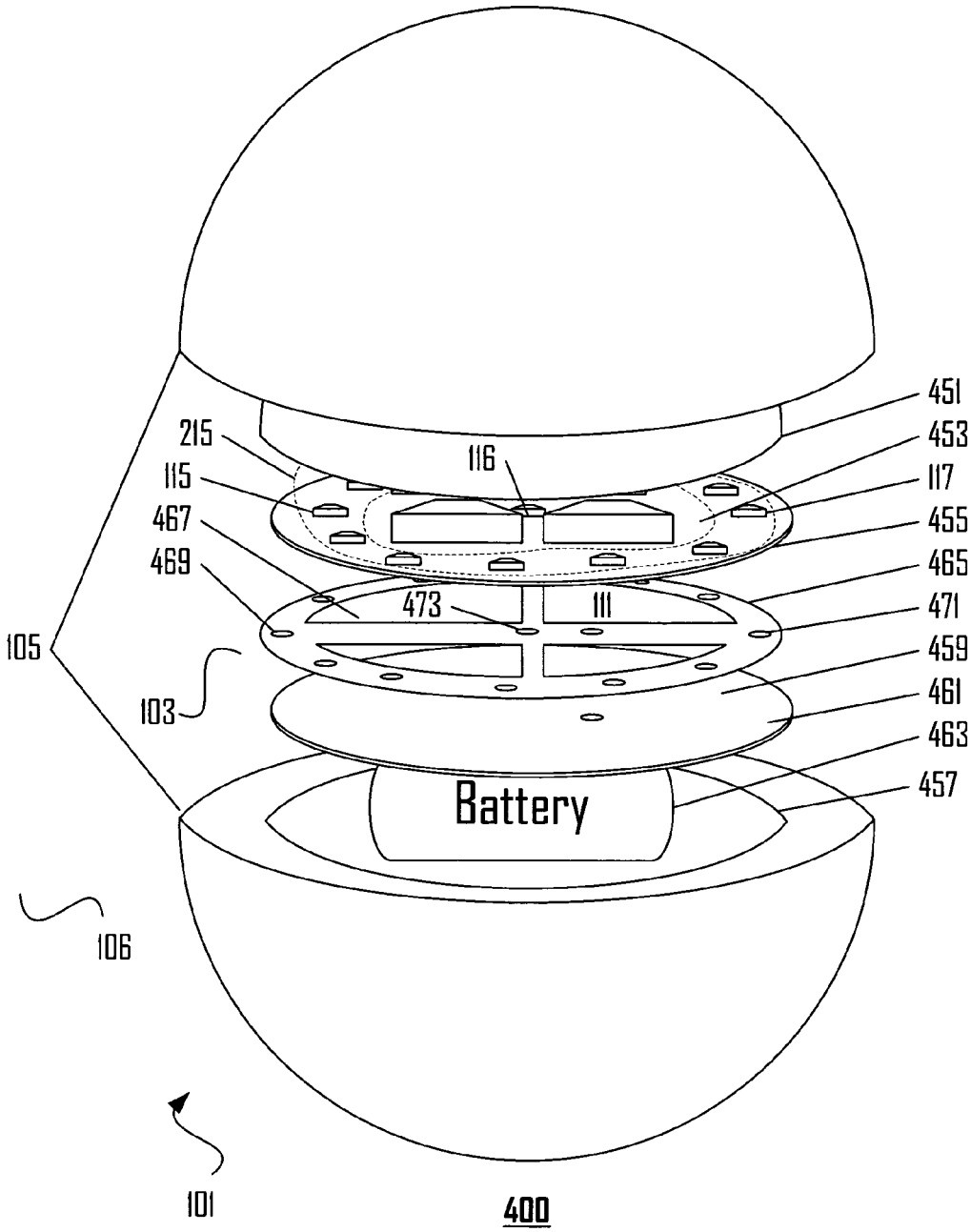
FIG. 4 is an exploded view of a preferred embodiment nano-antenna apparatus.

FIG. 4 is an exploded view 400 of a preferred embodiment nano-antenna apparatus 101. Nano-antenna apparatus 101 comprises dielectric layer 105 and conducting enclosure antenna 103. Conducting enclosure antenna 103 further comprises first conducting surface 107, second conducting surface 109, and gap region 111. Nano-antenna apparatus 101 occupies a substantially spheroidal volume.

First conducting hemisphere 451 and first ground plane 455 of first printed circuit board 453 cooperate to form first conducting surface 107. First conducting surface 107 forms a substantially closed conducting shell except for a limited number of optional pass-throughs, orifices, or vias to allow first printed circuit board 453 or other devices within first conducting surface 107 to connect to devices within second conducting surface 109, user interfaces, sensors, or other external devices. First printed circuit board 453 further provides a location for associated circuitry such as charging means 225 and discharge switching means 113. Additionally, first printed circuit board 453 may support control or processor functionality, sensor or transducer functionality, modulation functionality, input/output functionality, data storage functionality, or any other functionality useful for a particular application of nano-antenna device 101. In particular first printed circuit board 453 can support functionality to enable nano-antenna device 101 to be an electrically small transmitter capable of communication, positioning, radar, or other useful application. In alternate embodiments, first printed circuit board 453 can support functionality to enable nano-antenna device 101 to be a receiver as well as a transmitter. Any or all of these functionalities may be implemented in electronic devices within first conducting surface 107. "Electronic devices" include but are not necessarily limited to circuit board 453, other circuit boards, components, or other devices. Thus in a preferred embodiment, first conducting surface 107 is not only an antenna but also encloses electronic devices.

Second conducting hemisphere 457 and second ground plane 459 of second printed circuit board 461 cooperate to form second conducting surface 109. Second conducting surface 109 forms a substantially closed conducting shell except for a limited number of optional pass-throughs, orifices, or vias to allow second printed circuit board 461 or other devices within second conducting surface 109 to connect to devices within first conducting surface 107, user interfaces, sensors, transducers, or other external devices. For instance, second conducting surface 109 may enclose a battery 463 or other power supply means. Battery 463 may further function as a weight to tend to orient conducting enclosure antenna 103 in a desired orientation.

In alternate embodiments, printed circuit board 461 may be replaced by second ground plane 459 with adequate thickness to provide sufficient mechanical strength. In still further embodiments, second conducting hemisphere 457 and second ground plane 459 may cooperate to form an empty closed conducting shell. Thus, second conducting surface 109 behaves as an antenna element, but may or may not also be an enclosure.

First ground plane 455, second ground plane 459, and insulating spacer 465 cooperate to form gap region 111. Insulating spacer 465 may further comprise ribs 467 to provide additional mechanical support and to maintain a uniform spacing between first ground plane 455 and second ground plane 459. Insulating spacer 465 further comprises vias or passthroughs like first via 469 second via 471, and third via 473.

Discharge switching means 113 comprise a variety of discharge switches like first boundary discharge switch 115 and second boundary discharge switch 117. First boundary discharge switch 115 provides an electrical connection between first conducting surface 107 and second conducting surface 109, intermediate gap region 111 through first via 469. Similarly, second boundary discharge switch 117 provides an electrical connection between first conducting surface 107 and second conducting surface 109, intermediate gap region 111 through second via 471. In alternate embodiments, discharge switching means 113 may further comprise transmit/receive switching means to enable a nano-antenna device to receive signals as well as transmit.

Charging means 225 comprise a plurality of charging switches like charging switch 116. charging switch 116 provides an electrical connection between first conducting surface 107 and second conducting surface 109, intermediate gap region 111 through third via 473.

In a preferred mode of operation, discharge switching means 113 acts so as to unify first conducting hemisphere 451 and second conducting hemisphere 457 into a single closed conducting shell. In this embodiment, first conducting hemisphere 451 and second conducting hemisphere 457 enclose a substantially spheroidal volume. Thus, first conducting hemisphere 451 and second conducting hemisphere 457 form a Faraday cage that isolates interior energy in gap region 111 from exterior energy in dielectric layer 105 and surrounding space 106. Although discharge switch 215 is shown as a single ring of boundary discharge switches including first boundary discharge switch 115 and second boundary discharge switch 117, in practice discharge switch 215 may employ as many switches in as high a density and as thick a layer as are required to unify first conducting hemisphere 451 and second conducting hemisphere 457 into a single closed conducting shell well enough for a desired efficiency. As usual, a designer must weigh performance versus cost and complexity considerations.

ALTERNATE EMBODIMENTS

Preferred embodiment nano-antenna device 101 is substantially spheroidal. A spherical form factor is compact and produces a non-dispersive impulse waveform. A spherical form factor also lends itself well to theoretical analysis. The teachings of the present invention are not limited to spherical form factors, however. Alternate form factors include but are not limited to prolate spheroids, oblate spheroids, and Cartesian rectangular solids. Any form factor is likely to require modification and adaptation to the demands of a particular application, so these particular examples should be considered as merely illustrative and not exhaustive. This section will survey a few possible alternate form factors so as to give some small indication of the wide variety of variations possible for implementation of the present invention.

First Alternate Embodiment

Figure 5:
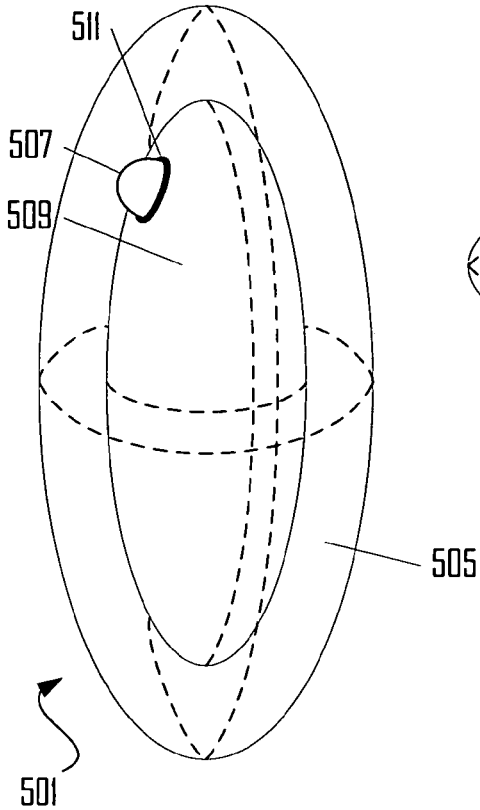
FIG. 5 is a schematic diagram of a first alternate embodiment nano-antenna apparatus.

FIG. 5 is a schematic diagram 500 of a first alternate embodiment nano-antenna apparatus 501. First alternate embodiment nano-antenna apparatus 501 comprises a dielectric layer 505, a first conducting surface 507 and a second conducting surface 509. First conducting surface 507 and second conducting surface 509 are separated by a gap region 511. First alternate embodiment nano-antenna apparatus 501 occupies a volume that is substantially similar to a prolate spheroid.

Although in general an approximate symmetry in relative size is preferred, first conducting surface 507 is much smaller in extent than second conducting surface 509. In this embodiment, first conducting surface 507 is a protuberance on second conducting surface 509. Such an asymmetric form factor is preferred if the frequency content of a desired radiated signal is higher than would otherwise be radiated by a symmetric configuration. Shaping of first conducting surface 507 and second conducting surface 509 also enables a degree of control over the radiated spectrum.

Second Alternate Embodiment

Figure 6:
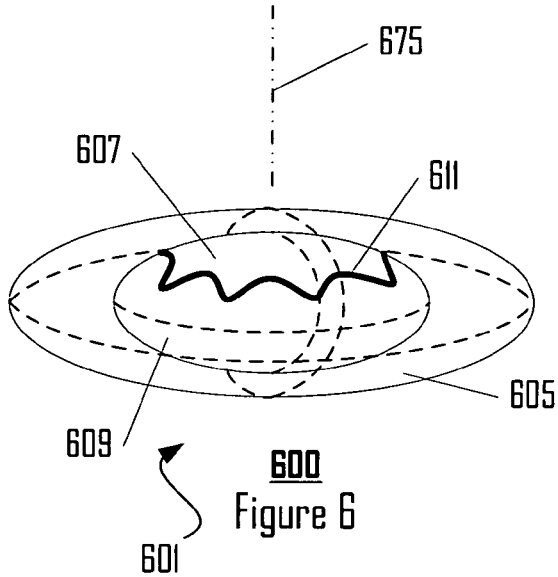
FIG. 6 is a schematic diagram of a second alternate embodiment nano-antenna apparatus.

FIG. 6 is a schematic diagram 600 of a second alternate embodiment nano-antenna apparatus 601. Second alternate embodiment nano-antenna apparatus 601 comprises a dielectric layer 605, a first conducting surface 607 and a second conducting surface 609. First conducting surface 607 and second conducting surface 609 are separated by a gap region 611.

Second alternate embodiment nano-antenna apparatus 601 has an oblate spheroidal form factor. Such a form factor is useful where a predictable device orientation is preferred. For instance, if nano-antenna apparatus 601 were deployed out of an aerial vehicle, nano-antenna apparatus 601 would likely come to rest with short axis 675 in a substantially vertical orientation.

Further, gap region 611 has a serrated or meandering form factor. The extra length of this serrated or meandering form factor helps concentrate additional electrostatic energy outside nano-antenna apparatus 601, thus making nano-antenna apparatus 601 more efficient.

Third Alternate Embodiment

Figure 7:
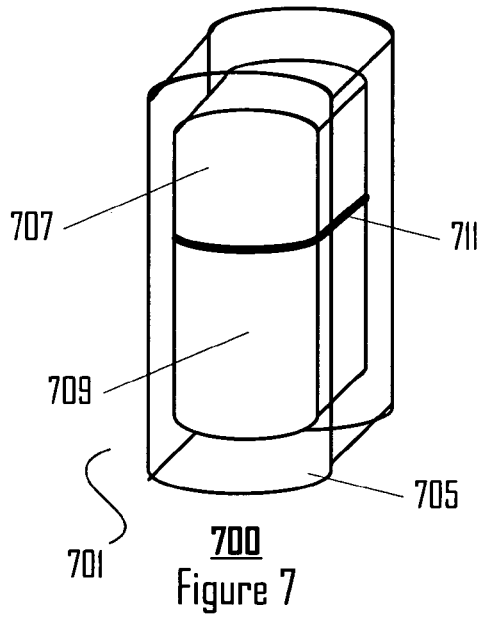
FIG. 7 is a schematic diagram of a third alternate embodiment nano-antenna apparatus.

FIG. 7 is a schematic diagram 700 of a third alternate embodiment nano-antenna apparatus 701. Third alternate embodiment nano-antenna apparatus 701 comprises a dielectric layer 705, a first conducting surface 707 and a second conducting surface 709. A first conducting surface 707 and a second conducting surface 709 are separated by a gap region 711.

Third alternate embodiment nano-antenna apparatus 701 has an approximately Cartesian rectangular solid form factor, preferred for many consumer devices. Various ratios of height to width to depth may be appropriate for various applications. Third alternate embodiment nano-antenna apparatus 701 may also be more manufacturable.

Specific alternate embodiments have been presented solely for purposes of illustration to aid the reader in understanding a few of the great many contexts in which the present invention will prove useful. It should also be understood that, while the detailed drawings and specific examples given describe preferred embodiments of the invention, they are for purposes of illustration only, that the apparatus and method of the present invention are not limited to the precise details and conditions disclosed and that various changes may be made therein without departing from the spirit of the invention which is defined by the following claims:

I claim:

1. A nano-antenna apparatus, said apparatus comprising:
a first conducting surface;
a second conducting surface;
a gap region between said first conducting surface and said second conducting surface; and
at least one discharge switch.

2. The apparatus in claim 1 in which said at least one discharge switch substantially isolates said gap region.

3. The apparatus in claim 2 further comprising a dielectric layer.

4. The apparatus in claim 2 in which at least one discharge switch operates at a time according to a pulse position modulation scheme.

5. The apparatus in claim 2 in which said first conducting surface is substantially symmetric with respect to said second conducting surface.

6. The apparatus in claim 2 in which said first conducting surface is substantially asymmetric with respect to said second conducting surface.

7. The apparatus in claim 2 further comprising a charging means said charging means being capable of polarized charging according to a flip or BPSK modulation scheme.

8. The apparatus in claim 1 in which said first conducting surface, said second conducting surface and said at least one discharge switch cooperate to form a substantially continuous closed conducting surface enclosing a volume.

9. The apparatus in claim 8 in which said volume is selected from the group including spheroids, prolate spheroids, oblate spheroids, and Cartesian rectangular solids.

10. The apparatus in claim 8 in which said volume encloses at least one electronic device.

11. The apparatus in claim 8 further comprising a dielectric layer.

12. The apparatus in claim 11 in which a dimension of said volume and a dielectric constant characterizing said dielectric layer cooperate to yield a desired frequency response.

13. The apparatus in claim 8 in which said substantially continuous closed conducting surface substantially partitions inside energy from outside energy.

14. The apparatus in claim 13 in which said partitioning results in decoupling of a substantial portion of outside energy as a radiated UWB impulse.

15. A method for transmitting UWB impulses, said method comprising the steps of:
charging a first conducting surface with respect to a second conducting surface;
discharging a first conducting surface with respect to a second conducting surface;
said discharging forming a substantially continuous closed conducting shell from a first conducting surface and a second conducting surface.

16. The method as in claim 15 in which said charging is adiabatic.

17. The method as in claim 15 in which said discharging is positioned in time according to a pulse position modulation scheme.

18. The method as in claim 15 in which said discharging is polarized according to a flip or BPSK modulation scheme.

19. The method as in claim 15 in which said discharging is effected by a switch selected from the group including diodes, transistors, MEMSs.

20. The method as in claim 15 in which said discharging is adiabatic.

* * * * *